United States Patent [19]

Kurths

[11] Patent Number: 4,821,060

[45] Date of Patent: Apr. 11, 1989

[54] APPARATUS FOR ATTACHING CLIPS TO LEADER BELTS FOR PHOTOSENSITIVE WEBS

[75] Inventor: Siegfried Kurths, Taufkirchen, Fed. Rep. of Germany

[73] Assignee: Agfa-Gevaert Aktiengesellschaft, Leverkusen, Fed. Rep. of Germany

[21] Appl. No.: 166,872

[22] Filed: Mar. 11, 1988

[30] Foreign Application Priority Data

Mar. 21, 1987 [DE] Fed. Rep. of Germany ..... 3709413

[51] Int. Cl.[4] ..... G03D 3/13; B65H 20/16

[52] U.S. Cl. ..... 354/321; 354/344; 226/92; 226/173; 29/235; 29/243.5

[58] Field of Search ..... 354/320, 321, 322, 340, 354/344, 345, 319; 226/91, 92, 173; 29/235, 243.5, 453

[56] References Cited

U.S. PATENT DOCUMENTS

| | | | |
|---|---|---|---|
| 2,878,924 | 3/1959 | Dye et al. | 354/321 X |
| 3,713,649 | 1/1973 | Van Kempen et al. | 226/92 |
| 4,055,289 | 10/1977 | Kaiser et al. | 354/340 X |
| 4,065,042 | 12/1977 | Zielinski | 226/92 |

*Primary Examiner*—A. A. Mathews

*Attorney, Agent, or Firm*—Peter K. Kontler

[57] ABSTRACT

Apparatus for separably connecting the leader of a web of photosensitive material to a running band which serves to pull the web through a processor employs a clip one portion of which is separably connected to the web and another portion of which is provided with a channel into which the band can enter only in response to a reduction of its effective width due to its innate elasticity and entrains the clip and the web through the processor. The mechanism for connecting the other portion of the clip to the band has a matrix at one side of the path of movement of the band opposite the open side of the channel in the other portion of the clip, and a deforming member which can be moved by a motor to cooperate with the matrix in deforming the band so that the effective width of the band is temporarily reduced to allow for introduction into the channel of the other portion of the clip. The matrix and/or a portion at least of the deforming member shares the movement of the band, at least during a certain stage of narrowing and subsequent widening of the band. This renders it possible to disengage the parts of the deforming mechanism from the band while one or more components of the deforming mechanism share the movement of the band.

23 Claims, 3 Drawing Sheets

APPARATUS FOR ATTACHING CLIPS TO LEADER BELTS FOR PHOTOSENSITIVE WEBS

BACKGROUND OF THE INVENTION

The invention relates to web transporting apparatus in general, and more particularly to improvements in apparatus for transporting webs of photosensitive material (such as exposed photographic roll films or exposed photographic paper) through one or more tanks, dryers and like constituents of a processor, e.g., a developing machine. Still more particularly, the invention relates to improvements in apparatus of the type wherein a so-called leader belt or band is used to advance one or more webs of photosensitive material in a processor through the medium of a so-called clip which is a device for connecting a selected portion of the running leader band to the leader of the web of photographic material.

The clip which serves to connect the band with the leader of a web of photographic material normally comprises an arm one end portion of which is connectable with the leader of the web and the other end portion of which is connectable with the band, normally in such a way that the band is maintained in a pronounced frictional engagement with the other end portion of the clip. Reference may be had to German Pat. No. 25 12 826 which discloses a presently known mode of attaching the other end portion of the clip to the band. A selected portion of the band is caused to bulge and the clip is then moved into engagement with such portion of the band before the bulge is allowed to disappear or is reduced sufficiently to ensure that the clip is frictionally engaged and is ready to be entrained by the band. Problems arise when the clip is to be attached to a running band, especially to a band which is driven at an elevated speed, because this necessitates a highly accurate synchronization of movements of the clip into engagement with the bulging portion of the running band. Moreover, the interval which is available to complete the attachment of the clip to the running band is relatively short which further complicates the operation.

OBJECTS AND SUMMARY OF THE INVENTION

An object of the invention is to provide a web transporting apparatus with novel and improved means for reliably and rapidly attaching the clip for the leader of a web of photosensitive material to a selected portion of a running leader band.

Another object of the invention is to provide the apparatus with attaching means whose operation is not affected by the speed at which the leader band is advanced along its path.

A further object of the invention is to provide the attaching means with novel and improved means for deforming a selected portion of the leader band preparatory to attachment of such portion of the band to the clip.

An additional object of the invention is to provide a processor for exposed photographic films or photographic paper which embodies the above outlined apparatus.

Still another object of the invention is to provide the apparatus with novel and improved means for attaching the leader band to the leading portion of a web of photosensitive material by means of any one of presently known clips or by a specially designed clip.

A further object of the invention is to provide an apparatus which can establish a reliable connection between the band and the web within a short interval of time.

An additional object of the invention is to provide the apparatus with novel and improved means for regulating friction between the leader band and the component or components which are used to deform a selected portion of the belt preparatory to attachment to the clip.

Another object of the invention is to provide a motorized apparatus of the above outlined character which can be used as a superior substitute for heretofore known apparatus in existing processors and like machines for the treatment or processing of photosensitive material.

The apparatus of the present invention is used to transport webs of photographic material in a processor, e.g., to transport a series of spliced-together exposed photographic roll films or a strip of exposed photographic paper through a series of baths in a developing machine. The apparatus comprises an elongated driven transversely elastic band-like transporting element having a predetermined maximum width and being arranged to advance longitudinally in a predetermined direction along a predetermined path, and a clip or analogous means for connecting a web of photosensitive material to the transporting element including a first portion (e.g., the slotted end portion of an elongated arm) which is connectable with the leader of the web and a second or entraining portion which is connectable with the transporting element. The second portion defines a channel preferably having a second width at least slightly less than the maximum width of the transporting element and an open side having a third width less than the second width so that the effective width of the transporting element must be reduced to equal or to be less than the third width in order to enable or induce the transporting element to enter the channel of the second portion of the connecting means. The apparatus further comprises means for preferably separably attaching the second portion of the connecting means to the transporting element, and such attaching means comprises a support which is adjacent a portion of the predetermined path and has a socket or other suitable means for receiving the second portion of the connecting means in such orientation that the open side of the channel faces the transporting element in the aforementioned portion of the path, and means on or adjacent the support for deforming the transporting element to impart thereto an effective width that equals or is less than the third width so that the transporting element can enter the channel and can thereupon increase its effective width due to its innate tendency to reassume the maximum width and to thereby engage and entrain the second portion of the connecting means in the predetermined direction. The deforming means includes at least one component which is movable with the transporting element in the predetermined direction relative to or with the support, at least during a portion of the interval of reduction and subsequent increase of the effective width of the transporting element. This renders it possible to attach the second portion of the connecting means to the transporting element while the latter is running at full speed because the connecting operation takes place while a component of or the entire deforming means shares the movement of the transporting element in the predetermined direction.

The deforming means includes a matrix at one side of the aforementioned portion of the path and a male deforming member which is located opposite the matrix at the other side of the path. The male deforming member can constitute the aforementioned component of the deforming means; alternatively, the matrix and the male deforming member as well as the support can share the movement of the transporting element during attachment of second portion of the connecting means thereto.

In accordance with one presently preferred embodiment of the apparatus, the matrix includes an idler roller which offers little or no resistance to advancement of the transporting element in the predetermined direction because it is simply set in rotary motion as soon as it is contacted by the running transporting element. The matrix is adjacent the open side of the channel in the second portion of the connecting means, at least during the initial stage of the attaching operation. The matrix can resemble a spool or reel or a trough with an open-ended groove whose width increases in a direction toward the open side of the channel in the second portion of the connecting means in the aforementioned portion of the path. The centrally located section of such matrix is out of contact with the transporting element prior to start of the attaching step, and the matrix further includes two flanges which engage the respective marginal portions of the transporting element during reduction of effective width of the transporting element, namely while the aforementioned male deforming member is caused to move transversely of the path and toward the matrix to thus reduce the effective width of the transporting element. The second portion of the connecting means can include substantially hook-shaped projections which define and flank the open side of the channel, and the flanges of the matrix are then provided with spaced-apart surfaces which contact the marginal portions of the transporting element prior to a reduction of its effective width to, or to less than, the third width.

The deforming means can further comprise means for moving the deforming member substantially transversely of the path toward and away from the matrix, and means for articulately coupling the deforming member to the moving means. The coupling means can include a pivot member which defines a pivot axis extending transversely of the path, and the transporting element is caused to pivot the deforming member about such axis in a first direction through the medium of the second portion of the connecting means when the deforming member is already disengaged from the transporting element. The deforming means which includes such pivotally mounted deforming member preferably further comprises a coil spring or other suitable means for yieldably biasing the deforming member in a second direction counter to the first direction and against abutment means provided on the moving means to limit the extent of pivotal movement of the deforming member in the second direction. Such deforming member can include first and second prongs or analogous protuberances which are respectively engageable with the transporting element ahead of and behind the second portion of the connecting means (as seen in the predetermined direction). The second portion of the connecting means pivots the deforming member in the first direction by way of the first prong while the second portion advances in the predetermined direction as a result of frictional engagement with the transporting element whereby the deforming member becomes disengaged from the second portion of the connecting means in response to a predetermined pivotal movement in the first direction to thereupon pivot against the abutment means under the action of the biasing means.

The second portion of the connecting means can constitute a flat plate-like body having a square or rectangular window and two projections disposed in the window and defining the open side of the channel. The width and/or the length of the window preferably equals or approximates the maximum width of the transporting element. A portion of the transporting element overlies the window and is overlapped by the two projections when the connection between the second portion of the connecting means and the transporting element is established. The transporting element is then in frictional engagement with the projections and preferably also with the surfaces surrounding the window in the second portion of the connecting means.

The support can include a carriage for the matrix and for the male deforming member of the deforming means, and the apparatus can further comprise guide means for confining the carriage to movements in and counter to the predetermined direction. Such apparatus preferably further comprises means (such as one or more coil springs) for yieldably biasing the carriage in the predetermined direction, motor means operable to move the male deforming member against the transporting element in the aforementioned portion of the path and toward the matrix, and means (e.g., a normally open electric switch) for operating the motor means in response to actuation of such operating means by the carriage (or by a part which shares the movements of the carriage) against the opposition of the just mentioned biasing means. The carriage can be moved by hand counter to the predetermined direction and against the opposition of the means for biasing the carriage so as to initiate the operation of the motor means through the medium of the operating means.

The just described apparatus which embodies a carriage can further comprise means for reducing friction between the carriage and the guide means. The guide means can include a pair of rails which flank the carriage, and the friction reducing means can include follower means provided on the carriage and arranged to indirectly track the rails, and antifriction rolling elements (e.g., spheres) disposed between the follower means and the rails.

The motor means for the male deforming member can comprise a fluid-operated (e.g., pneumatic) motor, an electromagnet, a spring motor whose spring can be wound by hand to store energy and to propel the male deforming member toward the matrix in response to actuation of a trigger or the like, or any other suitable device which can be caused to propel the male deforming member against the respective side of the running transporting element so that the latter is caused to reduce is effective width as a result of movement against the matrix.

The matrix can be provided with means for propelling the transporting element into the channel. Such propelling means can include a spring-biased plunger which is mounted in the matrix opposite the open side of the channel and is movable substantially transversely of the path to propel the transporting element through the open end and into the channel as soon as the effective width of the transporting element is reduced to or below the third width.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
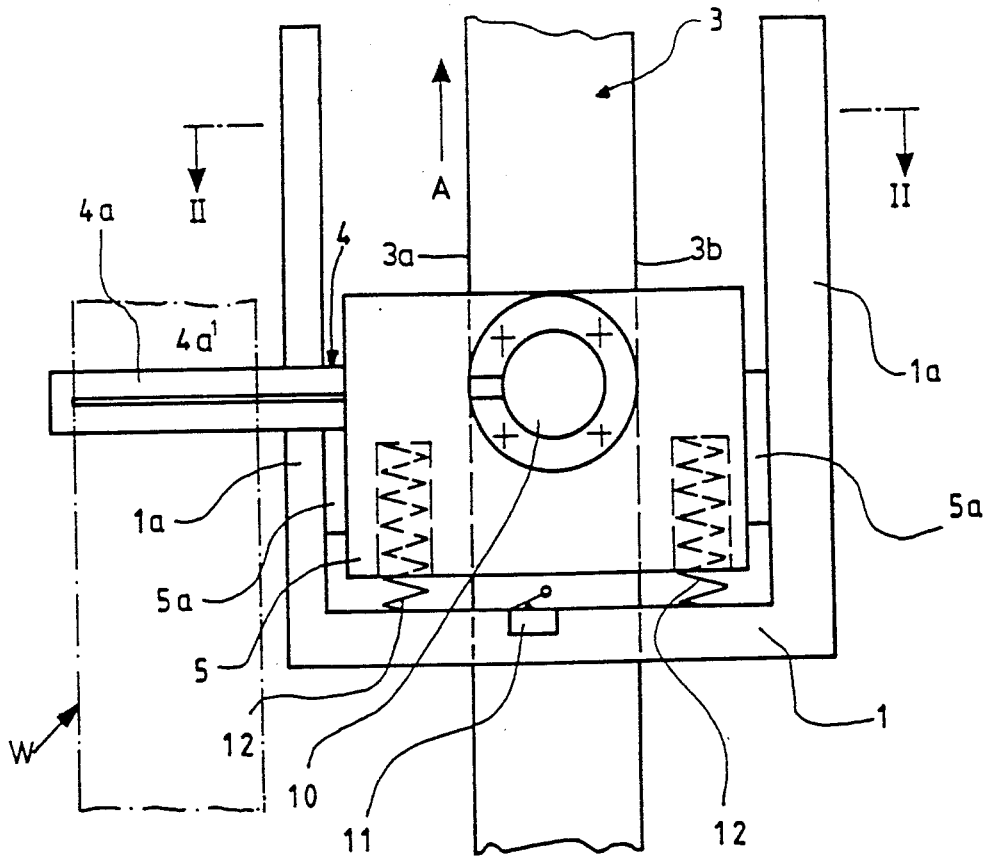
FIG. 1 is a schematic front elevational view of an apparatus which embodies one form of the invention and wherein the matrix of the deforming means has an open-ended groove for the deformed portion of the running transporting element.
Figure 2:
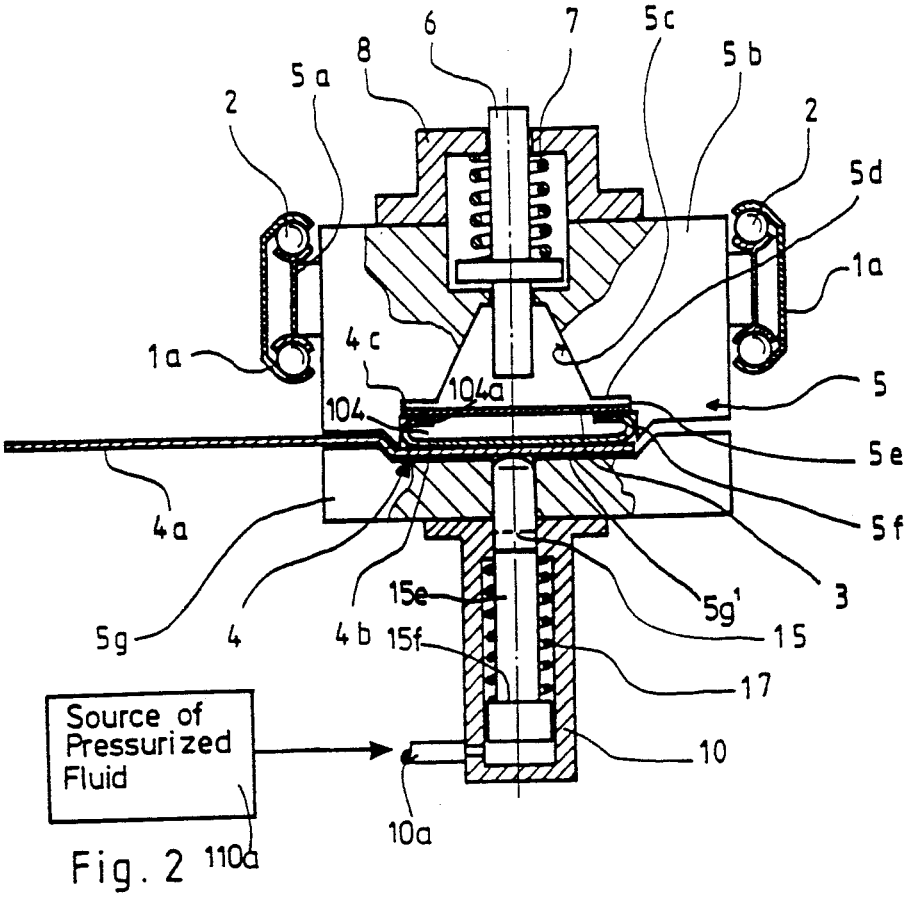
FIG. 2 is a sectional view as seen in the direction of arrows from the line II—II of FIG. 1, the portions of the motor and of the matrix broken away.

FIGS. 1 and 2 show an apparatus which can be used to transport a web W (indicated by phantom lines) through a processor wherein the photosensitive material of the web W can be caused to advance through a series of baths (e.g., a developing, fixing and a washing bath) prior to advancing through a dryer and onto a machine wherein the web is subdivided into sections of desired length (e.g., into sections of exposed roll film each of which contains a preselected number of frames or into discrete prints on exposed and developed photographic paper). Reference may be had to German Pat. No. 22 46 313 or to U.S. Pat. No. 4,065,042 to Zielinski which shows a portion of a processor for exposed webs of photosensitive material together with a source of such web material, a clip which can be used to separably connect the leader of the web to a running endless belt- or band-like transporting element, and means for guiding the running transporting element along a predetermined endless path.

The web W can have a length of several hundred meters and is to pass through a series of vessels including one or more deep or very deep vessels so that its leader must be reliably attached to and entrained by an elongated flexible endless belt- or band-like transporting element 3 which is driven to advance in the direction indicated by arrow A. The drive means for the element 3 can include one of the pulleys over which the transporting element 3 is trained and a motor which drives the one pulley in a manner well known from the art, e.g, in the same way as in numerous processors which are made and distributed by the assignee of the present application. The transporting element 3 (hereinafter called band for short) is continuously driven and can be made of a flexible synthetic plastic material which can stand the corrosive influence of the bath or baths in the processor as well as the elevated temperatures which are maintained in certain portions of the processor. The band 3 has a maximum width which is shown in FIG. 1; however, the effective width of the band 3 must be reduced preparatory to and during attachment of a selected portion of this band to the corresponding (second) portion **4*b* of a connecting device 4 (hereinafter called clip) which is used to separably couple the leader of the web W with the band 3. A reduction of effective width of the band 3 involves a movement of its marginal portions 3*a*, 3*b* nearer to each other so that the median portion of the band 3 bulges toward or away from the observer of FIG. 1. The clip 4 which is shown in FIGS. 1 and 2 constitutes but one of numerous clips which can be used in the improved apparatus to establish a separable connection between the leader of the web W and a selected portion of the running band 3. The illustrated clip 4 comprises a first portion which constitutes the free end portion of an elongated arm 4*a* and is formed with a slot 4*a*' extending transversely of the band 3 and serving to permit passage of the leader of the web W therethrough. The thus attached leader can be convoluted around the arm 4*a* or it can be secured to the web portion behind the arm 4*a*** by one or more staples (see the aforementioned patent to Zielinski) or in any other suitable way.

The second (entraining) portion **4*b* of the clip 4 has a channel 104 which is disposed between and is overlapped by two substantially hook- or tooth-shaped projections 4*c* and has a (second) width which is at least slightly less than the maximum width of the band 3. This can be seen in FIG. 2. The channel 104 has an open side 104*a* which faces upwardly (as seen in FIG. 2) and has a (third) width less than the width of the channel 104. Thus, in order to introduce a selected portion of the band 3 into the channel 104, it is necessary to reduce the effective width of the band to that, or to less than that, of the open side 104*a* before the band 3 can be caused to move downwardly (as seen in FIG. 2) and to enter the channel 104 by moving first through the open side 104*a*. The band 3 is then permitted to increase its effective width due to innate elasticity of its material so that the marginal portions 3*a*, 3*b* of the band frictionally engage the surfaces bounding the respective portions of the channel 104 and cause the entire clip 4 (and hence the web W) to share the movement of the band 3** in the direction of arrow A.

As a rule, or at least in many instances, the resistance of the band 3 to flexing in a sense to reduce its effective width is so pronounced that the required deforming action cannot be readily performed by hand, especially when the band 3 is in motion and travels in the direction of arrow A at an elevated speed. In accordance with a feature of the invention, the improved apparatus comprises novel and improved means for separably but firmly attaching the second portion **4*b* of the clip 4 to the band 3, and such attaching means includes means for reducing the effective width of a selected portion of the band 3 from the maximum width shown in FIG. 1 to a width which is required in order to ensure that the thus deformed (narrowed) portion of the band can pass between the projections 4*c* and enter the channel 104 of the second portion 4*b*. The flexibility of the band 3 cannot be reduced at will (e.g., to such an extent that the effective width of the band could be readily reduced by hand) because the band must be sufficiently stiff to ensure the establishment of a highly pronounced frictional engagement (at least) between is marginal portions 3*a*, 3*b* and the adjacent surfaces bounding the channel 104 when the band is free to increase its width and to thus frictionally engage the second portion 4b of the clip 4 so that the latter is invariably compelled to share the movement of the band 3** in the direction of arrow A.

That portion of the band 3 which is shown in FIG. 1 is assumed to travel upwardly, and the apparatus which includes the aforediscussed attaching means comprises a support 5 having a socket 5g' provided in a substantially plate-like or flat block-shaped section 5g of the support 5. The clip 4 which is shown in FIGS. 1 and 2 can be made of sheet steel stock and can include a first portion (arm 4a) and a second portion (4b) which is spot welded to the first portion. The socket 5g' constitutes a means for receiving the portion 4b of the clip 4 in such a way that the web W is somewhat spaced apart from and is parallel to the running band 3 at the start of the attaching operation. The support 5 is disposed between two parallel guide rails 1a which can constitute integral or detachable parts of a frame or housing 1 and wherein the support 5 is reciprocable in and counter to the direction of arrow A. As can be seen in FIG. 2, the guide rails 1a define longitudinally extending grooves for portions of two followers 5a which are provided on the larger section 5b of the support 5 and can travel in the respective guide rails 1a between two rows of spherical antifriction rolling elements 2 so that the support offers little resistance to movement in the direction of arrow A (except that it is urged downwardly toward the position of FIG. 1 under the action of gravity as well as under the weight of the web W when the latter's leader is already attached to the arm 4a). The manner in which the sections 5b, 5g of the support 5 (which is actually a relatively small and short carriage or slide) are separably connected to each other so as to allow for more convenient insertion of the second portion 4b of a clip 4 between them) is not specifically shown in the drawing. A quick-release connection is preferred so as to ensure that little time is lost for insertion of a fresh clip. FIG. 1 shows two coil springs 12 which flank the path of the band 3 and react against the transversely extending lower portion of the frame 1 to bias the support or carriage 5 upwardly, i.e., in the direction of arrow A. These springs serve as cushions which intercept the descending support 5 short of engagement of the lower end face of the support with the movable portion of an electric switch 11 which serves as a means for starting or initiating the operation of a fluid-operated (e.g., pneumatic) motor 10. The motor 10 forms part of the attaching means and its function is to propel a male deforming member 15 upwardly so that the two protuberances or prongs 15A, 15B (FIG. 3) of this deforming member engage the running band 3 in front of and behind the second portion 4b of the clip 4 in the support 5 and cause the band portion between the prongs 15A, 15B to enter a grooved matrix 5c of the support section 5b. This results in the aforediscussed deformation (reduction of effective width) of the band 3 so that the latter can be caused to pass through the open end 104a of and into the channel 104 prior to being allowed to increase its effective width and frictionally engage the portion 4b of the clip 4. As shown in FIG. 2, the right-hand end portion of the arm 4a of the clip 4 can be suitably deformed so as to ensure that the portion 4b can be properly seated in the socket 5g' which is provided in that side of the section 5g that faces the matrix 5c in the section 5b. The matrix 5c has an open-ended groove which extends at right angles to the plane of FIG. 2 and whose width increases in a direction toward the respective side of the running band 3, i.e., toward the open side 104a of the channel 104. The matrix 5c is disposed at one side and the male deforming member 15 and is located opposite the matrix at the other side of that portion of the path for the band 3 which extends between the sections 5b, 5g of the support or carriage 5.

Prior to being forced into the channel 104, the band 3 overlies the projections 4c of the second portion 4b of the clip 4 and its marginal portions 3a, 3b are adjacent two internal surfaces or shoulders 5d which are provided in the section 5b and extend at least slightly beyond the respective marginal portions so that the latter are spaced apart from vertically extending surfaces 5e which flank the surfaces 5d and are also provided in the section 5b. This ensures that the band 3 can run freely between the sections 5b, 5g prior to entry into the channel 104 and subsequent expansion to frictionally engage the portion 4b. The surfaces 5e are located inwardly of a socket or groove 5f which is provided in the section 5b and is sufficiently wide to receive the portion 4b with freedom of movement of the support 5 and clip 4 relative to each other in and counter to the direction of arrow A, i.e., the clip 4 can leave the sockets 5f, 5g' by moving upwardly, as seen in FIG. 1.

The matrix 5c which is shown in FIG. 2 defines a groove whose cross-sectional area is constant from end to end. However, it is equally possible to provide the matrix 5c with a groove which has a narrower central portion (e.g., exactly midway between the upper and lower end faces of the support 5) and two outer portions whose width increases in directions away from the narrower central portion. This even further enhances the deforming action of the surfaces bounding the groove of the matrix 5c in the support section 5b. In other words, the matrix 5c can be designed in such a way that the deformation (narrowing) of the band 3 is most pronounced in the middle between the upper and lower end faces of the support 5 and decreases in directions toward such end faces. The narrowing of the band 3 takes place in response to movement of the prongs 15A, 15B of the male deforming member 15 toward the matrix 5c in response to operation of the motor 10 so as to abruptly propel the member 15 toward the matrix whereby the prongs 15A, 15B engage the running band 3 ahead of and behind the portion 4b of the clip 4.

The matrix 5c is provided with a propelling or expelling device including a plunger 6 which is reciprocable at right angles to the plane of the adjacent portion of the band 3 and is biased into the groove of the matrix 5c by a coil spring 7 which reacts against a cupped spring housing 8 mounted at the exposed side of the section 5b. The spring 7 yields and stores energy when the band 3 is caused to undergo deformation in response to propulsion of the deforming member 15 toward the matrix 5c, but the spring 7 thereupon dissipates energy as soon as the effective width of the band 3 is reduced sufficiently so that the band can enter the open side 104a on its way into the channel 104. The tip of the plunger 6 can actually flatten the band 3 in the channel 4 so as to promote rapid widening of the band and hence the establishment of immediate frictional engagement with the surfaces bounding the channel 104.

The sockets 5f, 5g' preferably comprise pairs of mirror symmetrical halves so that a clip 4 can be inserted in a manner as shown in FIG. 2 or with its arm 4a extending to the right. Furthermore, the support 5 can receive the second portion of a clip (not shown) which has two arms extending beyond opposite sides of the support 5 and each capable of entraining the leader of a discrete web of photosensitive material. If desired, the sections 5b, 5g of the support 5 can be more or less permanently connected to each other; the clip 4 is then inserted from above so that its portion 4b is located at a level between the prongs 15A, 15B of the male deforming member 15.

The male deforming member 15 has a shank 15d which is reciprocable in a complementary hole or bore of the section 5g and has a shoulder 15f which is acted upon a coil spring 17 in the cylinder of the motor 10. When the deforming member 15 is to reduce the effective width of the band 3, the cylinder of the motor 10 receives a supply of pressurized fluid by way of a supply conduit 10a so that the spring 17 stores energy and the prongs 15A, 15B engage the running band 3 ahead of and behind the second portion 4b of the clip 4 in the sockets of sections 5b, 5g of the support 5. Before the conduit 10a admits pressurized fluid, the support 5 rests by gravity on the coil springs 12 whose characteristics are selected in such a way that the support 5 cannot open the switch 11, i.e., the motor 10 is idle and the band 3 can run along the matrix 5 without entraining the portion 4b of the clip 4. The support 5 is a lightweight body which can be readily depressed by hand so that the springs 12 yield and enable the section 5b or 5g to close the switch 11 whereby the latter opens a valve (not shown) which controls the flow of pressurized fluid from a suitable source 110a into the conduit 10a and thence into the cylinder of the motor 10.

The operation is as follows:

The first portion (arm 4a) of the clip 4 is connected to the leader of the web W in any suitable way, e.g., by passing the leader through the slot 4a' and by thereupon convoluting the leader around the arm 4a. If the web W is a strip of photographic paper, its leader can be folded over itself and the overlapping portions of the leader can be affixed to each other by one or more staples, by one or more paper clips or in any other suitable way which ensures that the web W is then compelled to share the movements of the arm 4a in the direction of arrow A. The portion 4b of the clip 4 is then introduced into the sockets 5f, 5g' from above so that it is located above the prong 15B but beneath the prong 15A of the (retracted) deforming member 15. This places the leader of the web W next to the selected side of the band 3 so that the web can be advanced along its path through one or more tanks and/or through other parts of the processor. The section 5b and/or the section 5g can be provided with a stop (not specifically shown) on which the portion 4b of the properly installed clip 4 comes to rest prior to connection of the portion 4b to the running band 3. Once the portion 4b comes to rest on the stop in the support 5, the latter is pushed downwardly against the resistance of coil springs 12 so that the switch 11 is actuated to operate the motor 10, i.e., to effect the admission of pressurized fluid via conduit 10a and the propulsion of deforming member 15 toward and into the groove of the matrix 5c so that the prongs 15A, 15B of the member 15 cause a narrowing of the adjacent portion of the running band 3 with the result that the effective width of the band is reduced to, or to less than, the width of the open side 104a of the channel 104. The valve which controls the flow of pressurized fluid immediately vents the conduit 10a so that the spring 17 is free to return the member 15 to the position of FIG. 2 whereby the spring 7 is free to dissipate energy and causes the plunger 6 to propel the deformed (narrowed) portion of the band 3 into the channel 104 where the band immediately increases its effective width and comes into frictional motion-transmitting engagement with the second portion 4b of the clip 4. A portion at least of the conduit 10a is flexible so that the entire support 5 can share the initial stage of movement of the clip 4 with the band 3 (arrow A). The stroke of the deforming member 15 into the groove of the matrix 5c is selected in such a way that the mutually inclined surfaces flanking the groove effect a sufficient narrowing of the corresponding portion of the band 3 to ensure that the plunger 6 can readily propel the narrowed band portion into the channel 104. The band 3 is positively urged (by the prongs 15A, 15B) into the groove of the matrix 5c ahead of and behind the portion 4b of the clip 4, i.e., the portion 4b of the clip is bypassed by the prongs on their way toward and also on their way away from the matrix 5c.

When the deforming member 15 is held in the retracted position of FIG. 2, the band 3 is free to travel relative to the clip 4 and relative to the support 5 because the distance between the surfaces 5e of the section 5b exceeds the maximum width of the band. However, as soon as the prongs 15A, 15B engage and deform the band 3 (in cooperation with the matrix 5c), the band 3 moves into pronounced frictional engagement with the tips of the prongs as well as with the surfaces bounding the groove of the matrix 5c so that the entire support 5 (and hence also the clip 4) is immediately accelerated to the speed of the band. At the very least, the prongs 15A, 15B urge the marginal portions 3a, 3b of the band 3 into pronounced frictional engagement with the surfaces 5d of the section 5b so that the latter is compelled to move with the band. Rapid acceleration of the support 5, motor 10, propelling device including the plunger 6, and clip 4 is assisted by the coil springs 12 which tend to move the support 5 upwardly, i.e., in the direction of arrow A. Frictional engagement between the support 5, deforming member 15, matrix 5c and plunger 6 on the one hand and the band 3 on the other hand is terminated as soon as the spring, 17, of the motor 10 is free to retract the deforming member 15 so that the second portion 4bof the clip 4 is then free to leave the space between the sections 5b, 5g of the support 5 and the support 5 can descend by gravity to be intercepted by the springs 12 before it can strike and actuate the switch 11. The clip 4 travels with the adjacent portion of the band 3 and pulls the web W through the processor.

The attaching means is then ready to secure a second clip 4 to a second web. For example, the second clip can be inserted between the sections 5b, 5g of the support 5 in such a way that its arm extends to the right (as seen in FIG. 1) and can entrain the second web in parallelism with the running web W but at the other side of the band 3.

It is clear that the clip 4 can be secured to a horizontal or substantially horizontal portion of the band 3. All that is necessary is to provide an additional spring or a set of additional springs tending to bias the support 5 in a direction toward the switch 11 because such movement of the support cannot take place by gravity.

The combined mass of parts which must be pulled by the band 3 when the latter is in engagement with the adjacent surfaces of the deforming member 15 and section 5b of the support 5 is small or negligible so that the braking action upon the band during the interval of acceleration of the support from zero speed to the speed of the band is minimal and can be disregarded. Therefore, the improved apparatus is especially suitable for use in processors and like machines wherein one or more webs of photosensitive material must be transported at a high or extremely high speed. The length of guide rails 1*a* and of the rows of rolling elements 2 therein is selected with a view to ensure that the support 5 can travel along such rails with a minimum of friction during the entire interval which elapses during acceleration of the support and during the following detachment of the support from the band so that the support can descend by gravity (if the band 3 travels upwardly) or that the support can reassume its starting position (corresponding to those shown in FIGS. 1 and 2) under the action of the aforementioned return spring or springs which are employed if the path of movement of the support 5 is horizontal or nearly horizontal.

Figure 3:
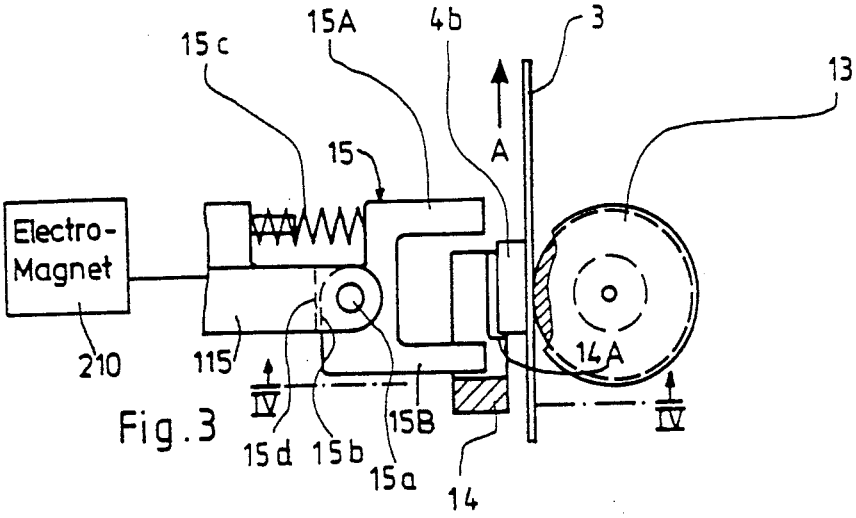
FIG. 3 is a fragmentary partly side elevational and partly sectional view of a second apparatus, with the section taken in the direction of arrows as seen from the line III—III in FIG. 4.
Figure 4:
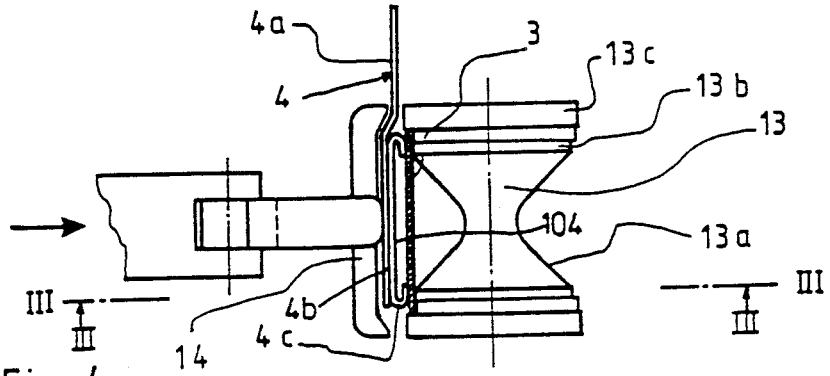
FIG. 4 is a view as seen in the direction of arrows from the line IV—IV of FIG. 3.

FIGS. 3 and 4 show a portion of a modified apparatus wherein a support 14 carries or cooperates with a discrete matrix 13 in the form of a spool or reel having an hourglass-shaped central portion 13*a* which cooperates with the prongs 15A, 15B of the male deforming member 15 to reduce the width of the band 3 and to enable the thus deformed band portion to enter the channel 104 of the second portion 4*b* of the clip 4. The manner in which the first portion (arm 4*a*) of the clip 4 of FIGS. 3–4 is connectable to the leader of a web is or can be the same as described in connection with FIGS. 1 and 2. The apparatus which embodies the structure of FIGS. 3–4 can be used with advantage in processors wherein the band 3 is advanced at a medium speed or at a relatively low speed. This apparatus can employ a band 3 which exhibits a higher degree of flexibility and whose elasticity is such that it does not increase its width prematurely, i.e., before the temporarily deformed portion enters the channel 104. Therefore, the propelling means including the plunger 6 and spring 7 of the matrix 5*c* shown in FIG. 2 can be omitted.

The central portion 13*a* of the matrix 13 is flanked by two cylindrical surfaces 13*b* on flanges which overlie the projections 4*c* of the second portion 4*b* of the clip 4. Such cylindrical surfaces 15*b* are flanked by additional cylindrical surfaces 13*c* on the flanges of the matrix 13; the pairs of neighboring cylindrical surfaces 13*b*, 13*c* define annular shoulders which guide the respective marginal portions of the band 3 in undeformed condition of the band. When the latter is deformed by the prongs 15A, 15B of the male deforming member 15, the marginal portions slide toward each other and engage the central portion 13*a* of the matrix 13 which is actually an idler roller offering a minimum of resistance to advancement of the band 3 in the direction of arrow A. Thus, the idler roller or matrix 13 is set in rotary motion as soon as it is contacted by the band 3, i.e., as soon as a motor 210 induces the deforming member 15 to move in a direction toward the matrix 13. The support 14 is provided with a stop 14A which maintains the clip 4 at an optimum level prior to connection of the clip portion 4*b* to the band 3. This support need not share the upward movement of the band 3 during attachment of the band to the portion 4*b* of the clip. However, the upward movement of the band 3 is shared by the deforming member 15 which is pivotably connected to a moving member 115 by means of a horizontal pivot pin 15*a* extending transversely of the band 3. The moving member 115 is part of the motor 210 and has an abutment 15*d* for the adjacent surface 15*b* of the member 15. A coil spring 15*c* is provided to yieldably bias the member 15 in a clockwise direction, as seen in FIG. 3, so that the surface 15*b*of the member 15 tends to engage the abutment 15*d* of the moving member 115.

The operation of the apparatus which includes the structure of FIGS. 3 and 4 is as follows:

The first portion (arm 4*a*) of the clip 4 is connected to the leader of a web of photosensitive material, and the second portion 4*b* of the clip is then placed onto the stop 14A of the support 14. The band 3 is free to run between the matrix 13 and the properly inserted portion 4*b* of the clip 4. The stop 14A can serve as a substitute for the switch 11 of FIG. 1, i.e., it can operate the motor 210 which includes the moving member 115 so that the latter moves the deforming member 15 toward the matrix 13 whereby the prongs 15A, 15B respectively engage the running band 3 at levels above and below the clip 4 on the support 14. The prongs 15A, 15B cooperate with the matrix 13 to reduce the effective width of the band 3 so that the latter can penetrate into the channel 104 (after having passed through the open side which faces the central portion 13*a* of the matrix 13) and can increase its width to frictionally engage and entrain the clip 4 on the leader of the web of photosensitive material. The marginal portions of the narrowed band 3 actually snap into the channel 104 and immediately begin to move apart so as to ensure the establishment of a reliable frictional engagement between the band and the portion 4*b* of the clip 4.

The member 15 thereupon begins to move back toward the position of FIG. 3, e.g., under the action of a spring corresponding to the spring 17 of FIG. 2.

When the motor 210 for the deforming member 15 is operated to move the prongs 15A, 15B against the running band 3, the latter continues to run relative to the member 15 (while the latter undergoes acceleration) so that the band tends to pivot the member 15 in a counterclockwise direction (as seen in FIG. 3) and to stress the coil spring 15*c*. Counterclockwise pivoting of the deforming member 15 is opposed by the coil spring 15*c* as well as by the moment which develops as a result of engagement between the prong 15B and the respective side of the running band 3. This moment is attributable to the lever arm between the axis of the pivot member 15*a* and the tip of the prong 15B. Such moment can be increased by shifting the pivot member 15*a* nearer to the level of the upper prong 15A, i.e., nearer to the level of engagement between the prong 15A and the band 3. The resistance to counterclockwise pivoting of the deforming member 15 about the axis of the pivot pin 15*a* suffices to ensure that the inclination of the member 15 relative to the moving device 115 does not change during acceleration of the member 15 as a result of frictional engagement of its prongs 15A, 15B with the band. As mentioned above, the matrix 13 can be said to constitute an idler roller which does not exert any braking action during engagement with the respective side of the band 3 because the latter simply sets the matrix in rotary motion so that frictional engagement between the band 3 and the deforming means of the structure shown in FIGS. 3–4 is limited to that between the band and the prongs 15A, 15B. When the deforming step is completed, i.e., when the aforementioned spring (corresponding to the spring 17 of FIG. 2) begins to retract the member 15 in a direction to the left, the frictional engagement between the band 3 and the prongs 15A, 15B is terminated because retraction of the member 15 takes place faster than a widening of the band in the channel 104 of the second portion 4*b* of the clip 4. However, the band 3 is already in frictional engagement with the portion 4b so that the clip 4 advances with the band at the exact speed of the band and its portion 4b engages the retreating prong 15A to pivot the deforming member 15 against the opposition of the coil spring 15c, i.e., the member 15 is then compelled to pivot in a counterclockwise direction. Such counterclockwise pivoting of the member 15 take place simultaneously with further retraction of the member 15 under the action of the moving member 115 and the aforementioned spring (17) so that the portion 4b of the clip 4 is free to bypass the upper prong 15A after a very short interval of time and can continue to move with and at the exact speed of the band 3. Once the clip 4 has risen above the prong 15A, the spring 15c is free to dissipate energy and to return the member 15 into engagement with the abutment 15d, i.e., the member 15 pivots in a clockwise direction and is ready for the next band-deforming operation. The spring 15c and the pivot member 15a ensure that the deforming member 15 cannot appreciably reduce the speed of the band 3 so that the latter can advance one or more webs of photosensitive material at an optimum speed which is required to ensure an optimal development, fixing, rinsing and/or other treatment of such web or webs. At any rate, even if the band 3 undergoes a certain amount of deceleration, the deceleration is minimal or negligible and does not unduly affect the quality of treatment of the web or webs.

Figure 5:
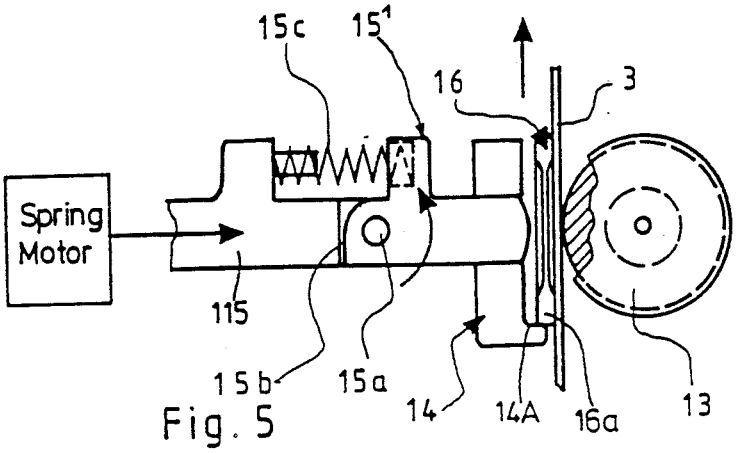
FIG. 5 is a view similar to that of FIG. 3 but showing a portion of a third apparatus using a modified connecting means, with a portion of the matrix broken away.

FIG. 5 shows a portion of a third apparatus wnerein the clip 4 of FIGS. 1 to 4 is replaced with a clip 16 of the type described and shown in commonly owned copending patent application Ser. No. 913,870 filed Oct. 1, 1986 by Ernst Schweiger for "Device for transmitting motion to webs of photographic material in developing machines and the like". The disclosure of this copending application is incorporated herein by reference. The second portion of the clip 16 (namely that portion which is to be connected to the running band 3) has a window having a length and a width which also match or closely approximate the maximum width of the band 3. The window contains two projections in the form of teeth which overlie one side of the band 3 when the connecting step is completed. A portion of the band 3 is then caused to bulge and to be confined in the window of the second portion of the clip 16. The entire clip 16 can be made of a single piece of synthetic plastic material and can resemble a flat plate-like body with an arm which constitutes the first portion and is connectable to the leader of a web of photographic material. The deforming means of the apparatus which embodies the structure of FIG. 5 employs a modified deforming member 15' which has a single prong serving to penetrate through the window of the clip 16 between the prongs and to cooperate with the matrix 13 (which can be identical with the matrix of FIGS. 3–4) to temporarily reduce the width of the band 3 so that the latter can snap behind the projections in the window of the respective connecting portion of the clip 16 and is then caused to remain in requisite frictional engagement with the running band 3. The entire member 15' is pivotable at 15a against the opposition of a coil spring 15c so as to be rapidly disengaged from the clip 16 when the latter begins to move with and at the speed of the band 3. The lower portion 16a of the frame around the window of the clip 16 then pivots the member 15' against the opposition of the spring 15cwhile the member 15' is being retracted by the moving member 115. It has been found that a matrix 13 in the form of an idler roller and configurated in a manner as shown in FIG. 4 is especially suitable to ensure proper narrowing (deformation) of the band 3 so that the latter can engage with the projections in the window of the clip 16 in a manner as disclosed in the copending application of Schweiger. This is due to the fact that the single prong of the deforming member 15' cooperates with the central portion of the matrix 13 at the exact locations where the band 3 must be narrowed to a maximum extent so as to be free to advance from one side of the projections in the window, between such projections and to expand at the other side of the projections into pronounced frictional engagement with the respective connecting portion of the clip 16.

FIG. 3 further shows schematically an electromagnet 210 which can be used as a motor to replace the fluid-operated motor 10 of FIGS. 1–2.

FIG. 5 shows a spring motor 310 with a spring (not shown) which can be wound not unlike the spring of a clock so as to store energy and to be permitted to dissipate energy when the clip 16 is properly placed onto the stop 14A of the support 14. The operative connection between the stop 14A and the means for permitting dissipation of energy by the spring of the motor 310 is not shown in FIG. 5.

An important advantage of the improved apparatus, wherein at least one component (such as 15 or 15') of the means for deforming the band 3 can share the movement of the band in the direction of arrow A is that the clip 4, 16 or another suitable clip can be properly connected to the band 3 even if and when the latter is driven to advance at a very high speed. Moreover, the deforming member 15 or 15' has ample time to become disengaged from the running band 3 since such disengagement can take place while the member 15 or 15' (or the entire deforming means) continues to move with the band 3. The fact that the band 3 can or does move relative to the clip during the initial stage of connecting operation does not affect the accuracy and predictability of the connecting operation because the manner in which the frictional engagement between the band and the deforming means first increases and thereupon decreases can be selected with a very high degree of accuracy and reproducibility. The apparatus can be used to connect the band 3 to successive webs of photosensitive material in rapid sequence, and it can also serve for simultaneous connection of two webs.

The deforming members 15 and 15' of FIGS. 3–5 need not move in the direction of arrow A in their entirety, i.e., it suffices if their prong or prongs have a component of movement in the direction of arrow A during pivoting about the axis of the respective pivot member 15a. As mentioned above, such pivoting takes place while the member 15 or 15' is in the process of being retracted from the associated matrix 13 so that the disengagement of the member 15 or 15' from the running band 3 (which is already connected with the clip 4 or 16) is practically instantaneous. As mentioned above, the apparatus of FIGS. 1–2 can be used with particular advantage when the band 3 is driven to advance at a high or very high speed.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the aforedescribed contribution to the art and, therefore, such adaptations should and are intended to be comprehended within the meaning and range of equivalence of the appended claims.

What is claimed is:

1. Apparatus for transporting webs of photosensitive material in a processor, comprising an elongated driven transversely elastic band-like transporting element having a predetermined maximum width and being arranged to advance in a predetermined direction along a predetermined path; means for connecting a web of photosensitive material to said element including a first portion connectable with the web and a second portion connectable with said element, said second portion defining a channel having a second width less than said maximum width and an open side having a third width less than said second width; and means for attaching said second portion to said element, including a support adjacent a portion of said path and having means for locating said second portion in such orientation that the open side of said channel faces the element in said portion of said path, and means for deforming said element to an effective width equal to or less than said third width so that said element can enter the channel and can thereupon increase its effective width due to its elasticity so as to engage and entrain the second portion in said direction, said deforming means including at least one component which is movable with said element in said direction, at least during a portion of the interval of reduction and increase of the effective width of said element.

2. The apparatus of claim 1, wherein said deforming means includes a matrix at one side of said portion of said path and a male deforming member opposite said matrix at the other side of said portion of said path.

3. The apparatus of claim 2, wherein said matrix includes an idler roller which offers little or no resistance to advancement of said element in said predetermined direction.

4. The apparatus of claim 2, wherein said matrix has a centrally located section which is out of contact with said element and two flanges which engage the marginal portions of said element preparatory to a reduction of the effective width of said element.

5. The apparatus of claim 4, wherein said second portion includes substantially hook-shaped projections which flank said open side and said flanges having spaced-apart surfaces which contact the marginal portions of said element prior to a reduction of the effective width of said element to, or to less than, said third width.

6. The apparatus of claim 2, wherein said deforming means further comprises means for moving said deforming member substantially transversely of said path toward and away from said matrix, and means for articulately coupling said deforming member to said moving means.

7. The apparatus of claim 6, wherein said coupling means includes a pivot member defining an axis extending transversely of said path, said element being arranged to pivot said deforming member about said axis in a first direction by way of said second portion while said deforming member is disengaged from said element upon completed reduction of the width thereof, said deforming means further comprising means for yieldably biasing said deforming member in a second direction counter to said first direction, and abutment means for limiting the extent of pivotal movement of said deforming member in said second direction.

8. The apparatus of claim 7, wherein said deforming member includes first and second prongs respectively engageable with said element ahead of and behind said second portion, as seen in said predetermined direction, and said second portion is arranged to pivot said deforming member in said first direction by way of said first prong as said second portion advances in said predetermined direction as a result of frictional engagement with said element whereby the deforming member becomes disengaged from said second portion as a result of predetermined pivotal movement in said first direction to thereupon pivot against said abutment means under the action of said biasing means.

9. The apparatus of claim 2, wherein said deforming member includes a first prong engageable with said element ahead of said second portion and a second prong engageable with said element behind said second portion, as seen in said direction.

10. The apparatus of claim 2, wherein said second portion includes a window and two projections disposed in said window and defining said open side, said window having a width approximating said maximum width.

11. The apparatus of claim 10, wherein said window has a length approximating said maximum width and said element has a portion which overlies said window and is overlapped by said projections upon completed connection of said second portion to said element.

12. The apparatus of claim 2, wherein said support includes a carriage and further comprising guide means for confining said carriage to movements in and counter to said direction.

13. The apparatus of claim 12, further comprising means for yieldably biasing said carriage in said direction.

14. The apparatus of claim 13, further comprising motor means operable to move said deforming member against said element in said portion of said path and toward said matrix, and means for operating said motor means in response to engagement by said carriage against the opposition of said biasing means.

15. The apparatus of claim 14, wherein said carriage is movable by hand counter to said direction and against the opposition of said biasing means so as to operate said motor means through the medium of operating means.

16. The apparatus of claim 12, further comprising friction reducing means interposed between said guide means and said carriage.

17. The apparatus of claim 16, wherein said guide means includes a pair of rails flanking said carriage and said friction reducing means includes follower means provided on said carriage and arranged to track said rails and antifriction rolling elements disposed between said follower means and said rails.

18. The apparatus of claim 2, wherein said matrix comprises means for propelling said element into said channel.

19. The apparatus of claim 18, wherein said propelling means includes a spring-biased plunger mounted in said matrix and movable substantially transversely of said path to propel said element through said open side and into said channel as soon as the effective width of said element is reduced to or below said third width.

20. The apparatus of claim 2, further comprising motor means for moving said deforming element transversely of said path toward said matrix.

21. The apparatus of claim 20, wherein said motor means comprises a fluid-operated motor.

22. The apparatus of claim 20, wherein said motor means comprises an electromagnet.

23. The apparatus of claim 20, wherein said motor means comprises a spring arranged to store energy for propulsion of said deforming member toward said matrix.

* * * * *